US008287617B2

(12) United States Patent
Nakatani

(10) Patent No.: US 8,287,617 B2
(45) Date of Patent: Oct. 16, 2012

(54) METHOD FOR PRODUCING ALLOY FINE PARTICLE COLLOID

(75) Inventor: Isao Nakatani, Ibaraki (JP)

(73) Assignee: National Institute for Materials Science, Ibaraki (JP)

( * ) Notice: Subject to any disclaimer, the term of this patent is extended or adjusted under 35 U.S.C. 154(b) by 861 days.

(21) Appl. No.: 12/226,620

(22) PCT Filed: Apr. 25, 2007

(86) PCT No.: PCT/JP2007/058973

§ 371 (c)(1),
(2), (4) Date: Feb. 23, 2009

(87) PCT Pub. No.: WO2007/125968

PCT Pub. Date: Nov. 8, 2007

(65) Prior Publication Data

US 2009/0151512 A1 Jun. 18, 2009

(30) Foreign Application Priority Data

Apr. 25, 2006 (JP) ..... 2006-120263

(51) Int. Cl.
*B22F 9/12* (2006.01)

(52) U.S. Cl. ..... 75/351; 75/367

(58) Field of Classification Search ..... 75/351, 75/367; 516/924, 928, 33
See application file for complete search history.

(56) References Cited

U.S. PATENT DOCUMENTS

| | | | | |
|---|---|---|---|---|
| 4,599,184 | A * | 7/1986 | Nakatani et al. | 252/62.51 R |
| 4,877,647 | A * | 10/1989 | Klabunde | 427/123 |
| 7,648,938 | B2 * | 1/2010 | Miyashita et al. | 502/182 |
| 7,780,876 | B2 * | 8/2010 | Nakatani | 252/512 |
| 2005/0019203 | A1 * | 1/2005 | Saitoh et al. | 420/506 |

FOREIGN PATENT DOCUMENTS

| | | |
|---|---|---|
| JP | 60-161490 | 8/1985 |
| JP | 60-162704 | 8/1985 |
| JP | 3-24207 | 2/1991 |

OTHER PUBLICATIONS

Alcock, C.B. et al., "Vapour Pressure Equations for the Metallic Elements: 298-2500 K", Canadian Metallurgical Quarterly, vol. 23, No. 3, pp. 309-313, 1984.*

(Continued)

*Primary Examiner* — George Wyszomierski
(74) *Attorney, Agent, or Firm* — Wenderoth, Lind & Ponack, L.L.P.

(57) ABSTRACT

A method for producing an alloy fine particle colloid by heating and evaporating a raw material binary alloy which is in a solid state in an ambient temperature and pressure environment in a reduced-pressure environment, cooling a generated vapor for condensation and solidification and collecting a formed alloy fine particle in a liquid medium, wherein (1) when an atomic fraction of a component element in the raw material alloy is defined as X, a component ratio of each of the elements of the raw material alloy is regulated such that a fraction of a vapor pressure of the component element to the total vapor pressure of the raw material alloy falls within the range of from (X−0.1) to (X+0.1); and (2) the raw material binary alloy is an alloy species which forms a homogeneous alloy phase in an alloy ingot. Thus, an alloy fine particle colloid is rationally and efficiently produced.

14 Claims, 6 Drawing Sheets

OTHER PUBLICATIONS

Geiger, F. et al., "The Vapor Pressure of Indium, Silver, Gallium, Copper, Tin, and Gold Between 0.1 and 3.0 Bar", International Journal of Thermophysics, vol. 8, No. 4, pp. 425-436, 1987.*

International Search Report dated Aug. 7, 2007 in the International (PCT) Application PCT/JP2007/058973 of which the present application is the U.S. National Stage.

* cited by examiner

METHOD FOR PRODUCING ALLOY FINE PARTICLE COLLOID

TECHNICAL FIELD

The present invention relates to a method for producing an alloy fine particle colloid.

BACKGROUND ART

As a method for producing a metal fine particle, there are known a physical method such as a vacuum vapor deposition method and a gas evaporation method; a chemical method such as a coprecipitation method and a hydrothermal method; and a mechanical method such as a pulverization method. Of these, the physical method is small in a problem of impurities remaining in a product fine particle and stable in quality as compared with other methods, and therefore, it is utilized for various materials and applications.

As to the vacuum vapor deposition method, in particular, there is a method called "continuous vacuum vapor deposition method onto active liquid surface", which a raw material metal is heated and evaporated in vacuo, and a vapor of an atomic metal of the raw material is brought into contact with the surface of a liquid medium to generate a fine particle on the surface of the liquid medium, thereby producing a fine particle colloid dispersed in the liquid medium (for example, Patent Documents 1 and 2), and this method is known as a method for producing a high-quality metal fine particle colloid having a nanometer size. FIG. 1 is a diagrammatic view showing this method and a production apparatus of a metal fine particle colloid utilizing this. According to this method, a metal vapor 10 evaporated from a metal evaporation source 5 is brought into contact with a liquid medium film 9 in an upper part of a rotary vacuum chamber 2; and a metal fine particle 11 formed therein is formed into a colloid particle covered by a surfactant molecule on the spot, which is then put on the rotation of the rotary vacuum chamber 2 and transported into a bottom. At the same time, a new liquid medium film 9 is supplied into the upper part of the rotary vacuum chamber 2 from the bottom. By continuously performing this process, a liquid medium 3 of the bottom is changed to a stable colloid dispersion 12 in which a metal fine particle is dispersed in a high concentration.

On the other hand, the gas evaporation method (for example, Non-Patent Document 1) is a method in which after exhausting a container, by introducing a small amount of an inert gas such as an argon gas and heating and evaporating a raw material metal in the container while keeping the inside thereof in a reduced pressure state of the inert gas, a metal vapor is cooled due to a collision with the inert gas molecule in the vicinity of an evaporation source to form a metal fine particle; at the same time, a vapor of an organic solvent is supplied in the vicinity of the evaporation source; and the formed metal finer particle is guided into an exhaust pipe along with a gas flow of the organic solvent, deposited in a low-temperature part of the exhaust pipe and subsequently recovered. As compared with the previous vacuum vapor deposition method, this gas evaporation method is not high in efficiency and economy because supply of a large quantity of heat energy is necessary for evaporating the metal. But, the gas evaporation method can be utilized as a method capable of producing a high-quality metal fine particle.

However, in the foregoing production methods of a metal fine particle colloid, in case of producing a fine particle colloid of an alloy composed of plural kinds of elements, there was involved a problem that a composition of the alloy fine particle to be formed gradually changes. This problem is caused due to the following.

That is, first of all, in case of using an alloy composed of element components A and B as a raw material alloy, an alloy $A_{1-X}B_X$ having a composition of an atomic ratio of the both of (1−X)/X is heated and melted in vacuo to form a homogeneous melt; when the temperature is further raised to vaporize it, the melt is radiated as a metal vapor in vacuo in a composition of an atomic ratio of (1−Y)/Y which is a ratio determined by vapor pressures inherent to the respective component elements; the element components respectively reach on a solid substrate or a liquid film of the liquid medium as referred to in this specification; and the A and B atoms are mutually condensed and solidified. When a condensation and solidification ratio is defined as (1−Z)/Z, an alloy fine particle having a composition of $A_{1-Z}B_Z$ formed. This is expressed by the following expression.

$$A_{1-X}B_X(s) \rightarrow A_{1-X}B_X(l) \rightarrow (1-Y)A(g)+YB(g) \rightarrow A_{1-Z}B_Z$$
(s)

Here, (s) stands for a solid state; (l) stands for a liquid state; and (g) stands for a gas state. Since it is considered that substantially all of atoms flying in vacuo are recovered, the relationship between Y and Z is Y=Z. Y does not depend upon X but depends upon the vapor pressures of the respective elements of the alloy. This is a so-called fractionation phenomenon and is a phenomenon which is utilized as a method for separation and purification using a different in boiling point of a multi-component solution such as a crude oil. When it is intended to evaporate an alloy of a fixed composition from a fixed amount of raw materials, evaporation preferentially occurs from a component having a higher vapor pressure; and as the raw materials are consumed, the composition ratio of the raw materials gradually changes, whereby a component having a lower vapor pressure finally remains. Accordingly, the alloy composition of a fine particle to be formed in the initial stage and the alloy composition of a fine particle to be formed in the final stage are largely different from each other so that it is difficult to obtain an alloy fine particle having a homogeneous composition.

As a countermeasure for avoiding such a problem, it may be considered to set up plural numbers of the metal element evaporation source 5. However, there are problems that the apparatus becomes large in size and complicated and that it is difficult to control the evaporation rate of each of the evaporation source.

Patent Document 1: JP-A-60-161490

Patent Document 2: JP-A-60-162704

Non-Patent Document 1: T. Suzuki and M. Oda, *Proceedings of IMC* 1996, *Omiya, pp.* 37, 1996

DISCLOSURE OF INVENTION

Problems that the Invention is to Solve

Then, under the foregoing background, a problem of the invention is to provide a new method for producing an alloy fine particle colloid capable of making it easy to control simply and easily an evaporation rate of an evaporation source and producing an alloy particle having a homogeneous composition without being accompanied with an increase in size and complication.

Means for Solving the Problems

In the method for producing an alloy fine particle colloid of the invention, the most important thing is based on the following as basic technical recognition.

In the case where an alloy $A_{1-X}B_X$ composed of components A and B is heated and evaporated in vacuo, when partial pressures $P_A$ and $P_B$ of the respective components are given in proportion to a component ratio of the alloy in the following manner, that system is called a regular system.

$$P_A=(1-X)P^o_A \quad (1)$$

$$P_B=XP^o_B \quad (2)$$

Here, $P^o_A$ and $P^o_B$ are evaporation pressures of pure substances A element and B element, respectively. This law is called the Raoult's law. In various alloy systems, it is extremely rare that the Raoult's law is held. In general, vapor pressures $P_A$ and $P_B$ of components of a vapor phase are not proportional to an atomic fraction of the alloy and can be expressed using activity coefficients $\gamma_A$ and $\gamma_B$ as follows.

$$P_A=\gamma_A(1-X)P^o_A \quad (3)$$

$$P_B=\gamma_B XP^o_B \quad (4)$$

$\gamma_A$ and $\gamma_B$ are each a value between 0 and 1 and an inherent amount regarding each alloy system and are each a complicated function of atomic fractions (1−X) and X. The values of $\gamma_A$ and $\gamma_B$ measured regarding each alloy system can be seen in the constant table (Non-Patent Document 1). $\gamma_A(1-X)$ is referred to as an activity $a_A$ of the component A in the alloy $A_{1-X}B_X$, and $\gamma_B \cdot X$ is referred to as $a_B$. Vapor pressures of the respective components using an activity are as follows.

$$P_A=a_AP^o_A \quad (5)$$

$$P_B=a_BP^o_B \quad (6)$$

When the ratio of (1−X)/X of the atomic fractions of the raw material alloy is set up such that fractions $a_AP^o_A/(a_AP^o_A+a_BP^o_B)$ and $a_BP^o_B/(a_AP^o_A+a_BP^o_B)$ of vapor pressures of the respective components are equal to atomic fractions of the raw material alloy, respectively:

$$a_AP^o_A/(a_AP^o_A+a_BP^o_B)=1-X \quad (7)$$

$$a_BP^o_B/(a_AP^o_A+a_BP^o_B)=X \quad (8)$$

in evaporation of the alloy, the alloy composition and the vapor composition to be evaporated are equal to each other, and a fractionation phenomenon is not caused with a lapse of the evaporation time. Such evaporation is named harmonic evaporation.

In order to solve the foregoing problems, the invention is based on importance of the foregoing harmonic evaporation.

The characteristic features of the production method of the invention are as follows.

First:

A method for producing an alloy fine particle colloid by heating and evaporating a raw material binary alloy which is in a solid state in an ambient temperature and pressure environment in a reduced-pressure environment, cooling a generated vapor for condensation and solidification and collecting a formed alloy fine particle in a liquid medium, wherein (1) when an atomic fraction of a component element in the raw material alloy is defined as X, a component ratio of each of the elements of the raw material alloy is regulated such that a fraction of a vapor pressure of the component element to the total vapor pressure of the raw material alloy falls within the range of from (X−0.1) to (X+0.1); and (2) the raw material binary alloy is an alloy species which forms a homogeneous alloy phase in an alloy ingot.

Here, the "colloid" as referred to in the invention is a general term of a fine particle (colloid particle) dispersed and stabilized by a surface treatment with a surfactant and a dispersion (colloid solution) in which it is dispersed in a liquid medium.

Second:

A method for producing an alloy fine particle colloid by heating and evaporating a raw material binary alloy which is in a solid state in an ambient temperature and pressure environment in vacuo in a degree of vacuum of not more than $5\times10^{-4}$ Torr, cooling a generated vapor for condensation and solidification by bringing it into contact with the surface of a liquid medium and dispersing a formed alloy fine particle in the liquid medium, wherein (1) when an atomic fraction of a component element in the raw material alloy is defined as X, a component ratio of each of the elements of the raw material alloy is regulated such that a fraction of a vapor pressure of the component element to the total vapor pressure of the raw material alloy falls within the range of from (X−0.1) to (X+0.1); and (2) the raw material binary alloy is an alloy species which forms a homogeneous alloy phase in an alloy ingot.

Third:

Production of an alloy fine particle colloid of Ag and In according to the foregoing first or second production method, wherein a composition of the raw material alloy is $Ag_{1-X}In_X$ ($0.0<X\leqq0.20$).

Fourth:

Production of an alloy fine particle colloid of Au and Pd according to the foregoing first or second production method, wherein a composition of the raw material alloy is $Au_{1-X}Pd_X$ ($0.0<X<1.0$).

Fifth:

Production of an alloy fine particle colloid of Au and Sn according to the foregoing first or second production method, wherein a composition of the raw material alloy is $Au_{1-X}Sn_X$ ($0.0<X\leqq0.16$).

Sixth:

Production of an alloy fine particle colloid of Co and Fe according to the foregoing first or second production method, wherein a composition of the raw material alloy is $Co_{1-X}Fe_X$ ($0.0<X<1.0$).

Seventh:

Production of an alloy fine particle colloid of Co and Ni according to the foregoing first or second production method, wherein a composition of the raw material alloy is $Co_{1-X}Ni_X$ ($0.0<X<1.0$).

Eighth:

Production of an alloy fine particle colloid of Co and Pd according to the foregoing first or second production method, wherein a composition of the raw material alloy is $Co_{1-X}Pd_X$ ($0.0<X<1.0$).

Ninth:

Production of an alloy fine particle colloid of Cr and Ni according to the foregoing first or second production method, wherein a composition of the raw material alloy is $Cr_{1-X}Ni_X$ ($0.75\leqq X<1.0$).

Tenth:

Production of an alloy fine particle colloid of Cu and Si according to the foregoing first or second production method, wherein a composition of the raw material alloy is $Cu_{1-X}Si_X$ ($0.0<X\leqq0.45$).

Eleventh:

Production of an alloy fine particle colloid of Cu and Sn according to the foregoing first or second production method, wherein a composition of the raw material alloy is $Cu_{1-X}Sn_X$ ($0.0<X\leqq0.33$).

Twelfth:

Production of an alloy fine particle colloid of Fe and Ni according to the foregoing first or second production method, wherein a composition of the raw material alloy is $Fe_{1-X}Ni_X$ ($0.60 \leqq X < 1.0$).

Thirteenth:

Production of an alloy fine particle colloid of Fe and Pd according to the foregoing first or second production method, wherein a composition of the raw material alloy is $Fe_{1-X}Pd_X$ ($0.64 \leqq X < 1.0$).

Fourteenth:

Production of an alloy fine particle colloid of Fe and Si according to the foregoing first or second production method, wherein a composition of the raw material alloy is $Fe_{1-X}Si_X$ ($0.30 \leqq X \leqq 0.37$).

Fifteenth:

Production of an alloy fine particle colloid of Ni and Pd according to the foregoing first or second production method, wherein a composition of the raw material alloy is $Ni_{1-X}Pd_X$ ($0.0 < X < 1.0$).

Sixteenth:

Production of an alloy fine particle colloid of Ag and Cu according to the foregoing first or second production method, wherein a composition of the raw material alloy is $Ag_{1-X}Cu_X$ ($0.0 < X \leqq 0.25$).

Advantages of Invention

According to the invention, it is possible to solve the problems of the conventional technologies and to provide to produce an alloy fine particle colloid having a homogeneous composition which is capable of making it easy to control simply and easily an evaporation rate of an evaporation source without being accompanied with an increase in size and complication.

In more detail, according to the first invention, it is possible to produce an alloy fine particle colloid which has a small particle size, is monodispersed and has a homogeneous composition.

According to the second invention, it is possible to produce an alloy fine particle which has a small particle size, is monodispersed and has a homogeneous composition efficiently and economically at low energy.

Then, according to the third to sixteenth inventions, it is possible to produce an Ag—In alloy fine particle colloid, an Au—Pd alloy fine particle colloid, an Ag—Sn alloy fine particle colloid, a Co—Fe alloy fine particle colloid, a Co—Ni alloy fine particle colloid, a Co—Pd alloy fine particle colloid, a Cr—Ni alloy fine particle colloid, a Cu—Si alloy fine particle colloid, a Cu—Sn alloy fine particle colloid, an Fe—Ni alloy fine particle colloid, an Fe—Pd alloy fine particle colloid, an Fe—Si alloy fine particle colloid, an Ni—Pd alloy fine particle colloid and an Ag—Cu alloy fine particle colloid, each of which has a small particle size, is monodispersed and has a homogeneous composition.

DESCRIPTION OF REFERENCE NUMERALS AND SIGNS

Figure 1:
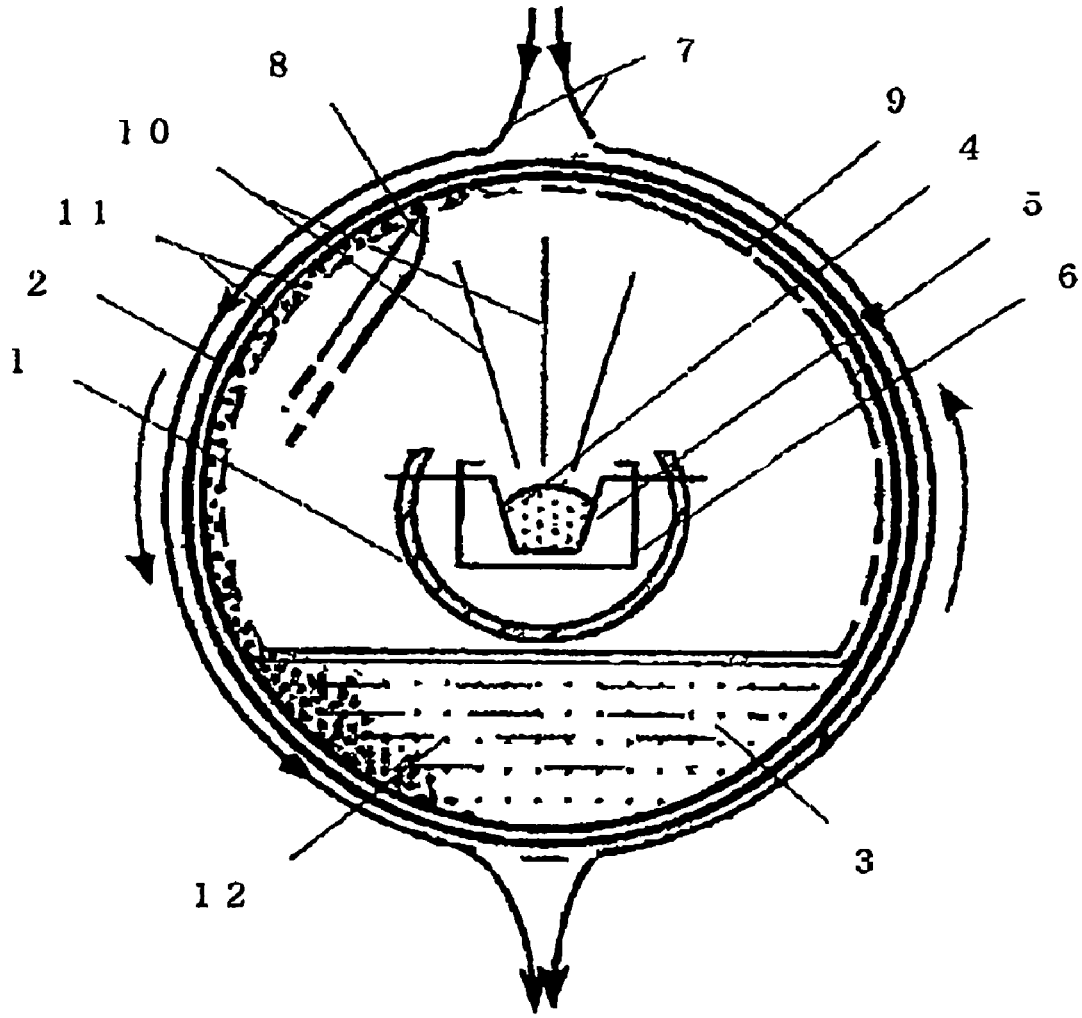
FIG. 1 is a diagrammatic view of the method of a continuous vacuum vapor deposition onto an active liquid surface.

1: Fixed axis
2: Rotary vacuum chamber
3: Liquid medium having a surfactant added thereto
4: Raw material metal (alloy)
5: Evaporation source
6: Radiation insulating plate
7: Cooling water flow
8: Thermocouple
9: Liquid film of liquid medium containing a surfactant
10: Metal vapor
11: Metal (alloy) fine particle coated by a surfactant molecules
12: Colloid dispersion of metal (alloy) fine particle

BEST MODE FOR CARRYING OUT THE INVENTION

Though the invention has the foregoing characteristic features, embodiments thereof are hereunder described.

First of all, constitutional elements of the "raw material alloy" in the invention is a compound composed of two kinds of metal elements or a compound composed of a single kind of a metal element and a single kind of a non-metal element and is an alloy species which forms a homogeneous alloy phase in an alloy ingot of a macroscopic size of at least a microscopically observable size or more. In the invention, the "homogeneous alloy phase" is a phase of an alloy having at least a microscopically observable size and having homogeneous composition and structure and refers to a phase which forms a solid solution. In the invention, the "alloy species" refers to the kind of an alloy to be distinguished from the kind of elements forming the alloy in terms of a proportion (composition) of the respective component elements. As a combination of elements of the alloy "which forms a homogeneous alloy phase in an alloy ingot of a macroscopic size", it is known that a number of combinations including Ag—In, Au—Pd, Au—Sn, Co—Fe, Co—Ni, Co—Pd, Cr—Ni, Cu—Si, Cu—Sn, Fe—Ni, Fe—Pd, Fe—Si, Ni—Pd and Ag—Cu exist. In the case where the alloy is defined as A-B, when an atomic fraction of the component element B in the alloy is X, a composition formula of the raw material alloy is $A_{1-X}B_X$. The composition of the raw material alloy for the achievement of harmonic evaporation can be determined by a graphical method by using the foregoing expressions (7) and (8) and employing known values $a_A$, $a_B$, $P^o_A$ and $P^o_B$ regarding all possible kinds of a binary alloy.

Figure 2:
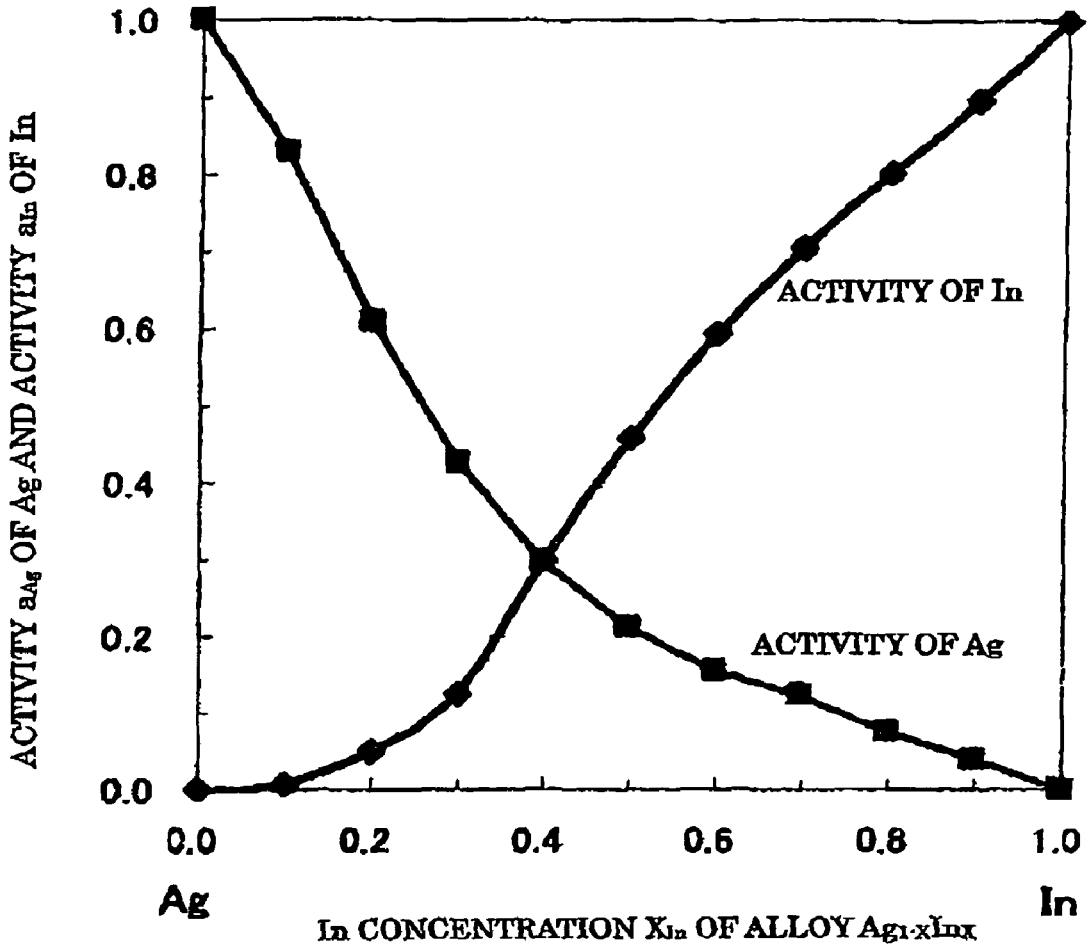
FIG. 2 is a graph in which activities $a_{Ag}$ and $a_{In}$ of Ag and In are each plotted against an atomic fraction X of In over the total composition of an $Ag_{1-X}In_X$ alloy.

A graphical method for determining an alloy composition for the achievement of harmonic evaporation is hereunder described with reference to an Ag—In alloy as an example. In an Ag—In alloy system, activities $a_{Ag}$ and $A_{In}$ of Ag and In over the total composition of an $Ag_{1-X}In_X$ alloy at 1,300 K (=1,027° C.) which is a typical temperature at which the component elements evaporate are shown in FIG. 2. Since an activity of a component element is a parameter of evaporation properties of the component element, an evaporating pressure of In evaporating from a melt increases with an increase of the In concentration of the $Ag_{1-X}In_X$ alloy, whereas a vapor pressure of Ag inversely decreases with a decrease of the Ag concentration. However, the matter that the both curves irregularly become largely convex downward means that the both are hardly evaporated from the alloy melt due to the coexistence of the Ag atom and the In atom as compared with the case of a single metal. This is because the binding energy between the Ag and In atoms is larger than that between the Ag atoms each other or the In atoms each other. At 1,300 K (1,027° C.), the single metals of Ag and In have inherent vapor pressures ($P^o_{Ag}$=1.31 Pa, $P^o_{In}$=1.69 Pa), respectively. Values of vapor pressures of Ag and In evaporating from the $Ag_{1-X}In_X$ alloy at 1,300 K (1,027° C.) can be calculated according to the following expressions.

$$P_{Ag}=a_{Ag}P^o_{Ag} \quad (9)$$

$$P_{In}=a_{In}P^o_{In} \quad (10)$$

Figure 3:
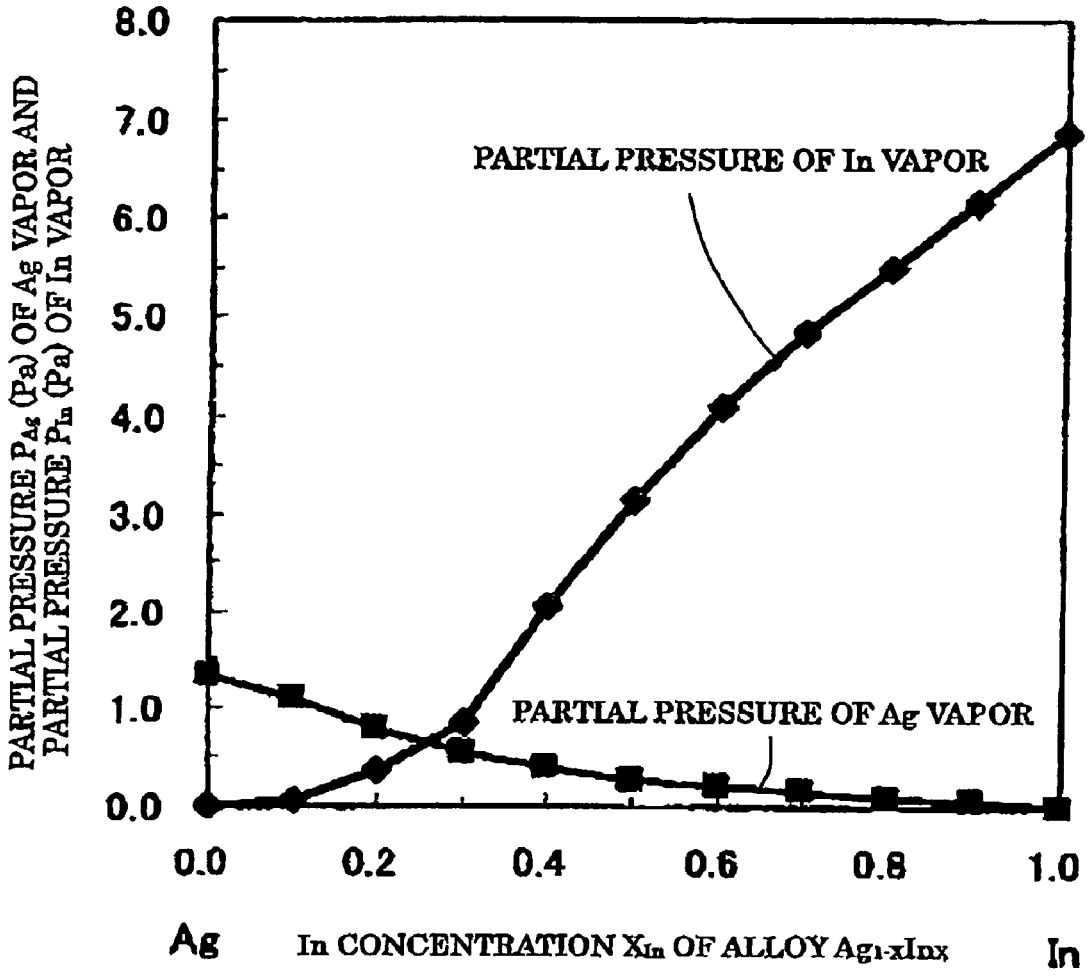
FIG. 3 is a graph in which vapor pressures $P_{Ag}$ and $P_{In}$ of Ag and In are each plotted as a function of an atomic fraction X of In of an $Ag_{1-X}In_X$ alloy.

$P_{Ag}$ and $P_{In}$ are each shown in FIG. 3 as a function of an atomic fraction X of In of the $Ag_{1-X}In_X$ alloy. In FIG. 3, the intercepts on the ordinate show values of vapor pressures of pure substances of Ag and In, respectively, and the graph shows an absolute value of each of the vapor pressures of Ag and In. A proportion of each of the component vapors to the total pressure, namely a fraction of the vapor pressure of each of the components is given as follows.

$$\text{Fraction of In vapor pressure, } Y_{In}=P_{In}/(P_{Ag}+P_{In}) \quad (11)$$

$$\text{Fraction of Ag vapor pressure, } Y_{Ag}=P_{Ag}/(P_{Ag}+P_{In}) \quad (12)$$

$$=1-Y_{In} \quad (13)$$

Figure 4:
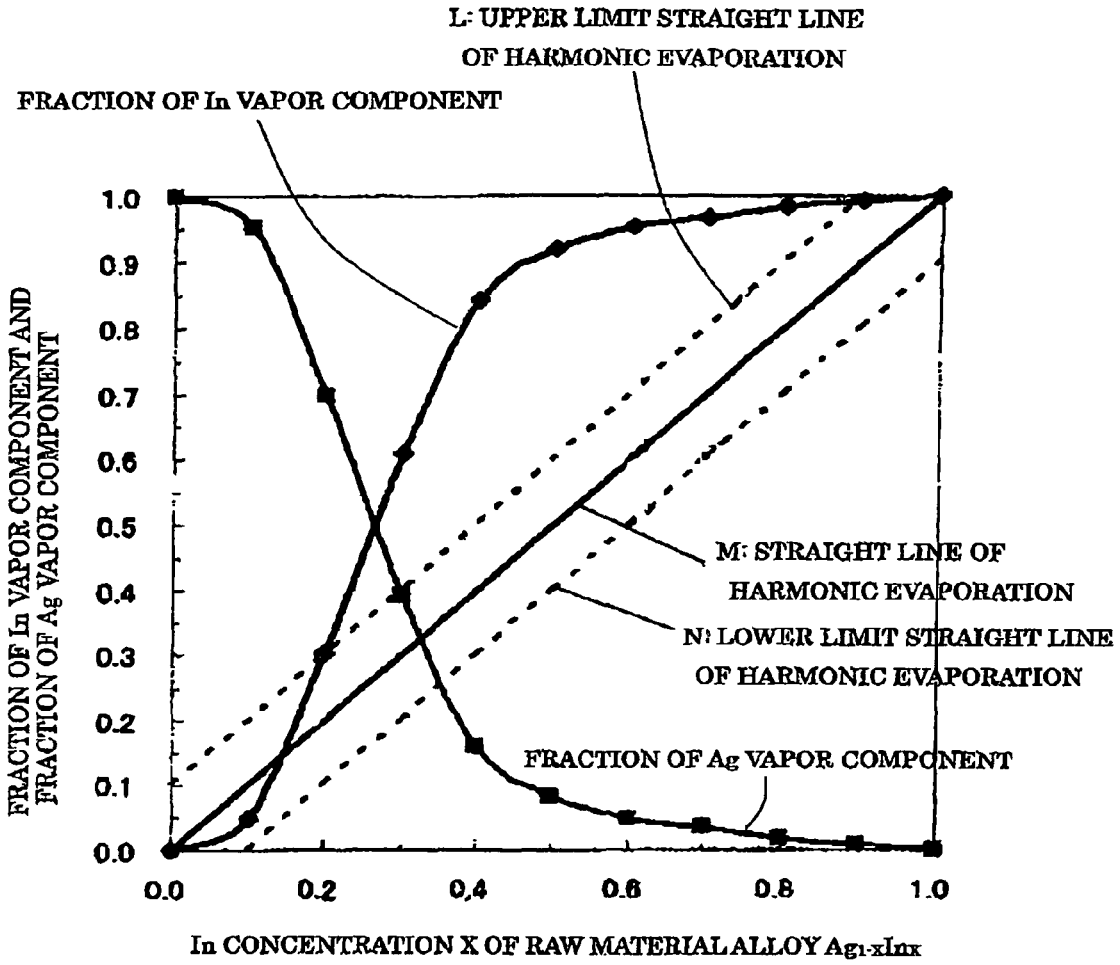
FIG. 4 is a graph in which partial pressures $Y_{Ag}$ and $Y_{In}$ of Ag and In are each plotted as a function of an atomic fraction X of In of an $Ag_{1-X}In_X$ alloy.

$Y_{Ag}$ and $Y_{In}$ are each shown in FIG. 4 as a function of an atomic number fraction X of the $Ag_{1-X}In_X$ alloy melt.

FIG. 4 shows the relationship between the melt composition of the raw material alloy and the vapor phase composition evaporating therefrom. In FIG. 4, when an upward-sloping straight line M at 45° which passes through the origin is drawn, a point P at which a curve showing the fraction of the In vapor pressure intersects with the straight line M is a composition for the achievement of harmonic evaporation in which the composition of the raw material melt and the composition of the vapor coincide with each other. By reading out the coordinates of the point P from FIG. 4, the composition for the achievement of harmonic evaporation of the $Ag_{1-X}In_X$ alloy is determined to be $Ag_{0.86}In_{0.14}$. In the invention, the thus determined value of X is referred to as a harmonic composition. Next, in a region interposed between a straight line L having an inclination of 45° which passes through a point (0, 0.1) and a straight line N having an inclination of 45° which passes through a point (0.1, 0), a fraction $Y_{In}$ of the In vapor pressure to the atomic number fraction X of In in the raw material $Ag_{1-X}In_X$ is satisfied with the following relationship.

$$(X-0.10)\leqq Y_{In}\leqq(X+0.10) \quad (14)$$

Namely, a deviation between the atomic number fraction of the raw material and the fraction of the vapor pressure falls within the range of ±0.10. When the atomic number fraction X whose partial pressure curve falls within this range is directly read out from FIG. 4, in order to make a deviation between the atomic number fraction of the raw material and the fraction of the vapor pressure fall within the range of ±0.10, it is noted that a raw material having a composition falling within the range: $0\leqq X\leqq 0.2$ may be used. In the invention, the thus determined range is referred to as a tolerable composition range.

By selecting the elements and composition ratio of the alloy in this way, a homogeneous alloy fine particle can be obtained.

As to the harmonic evaporation composition, so far as an $Au_{1-X}Pd_X$ alloy is concerned, for example, from activity values $a_{An}$ and $a_{Pd}$ of the respective component elements at 1,727° C. to the atomic fraction and vapor pressures of respective pure substances at 1,727° C., $P^o_{Au}$=3.40×10 Pa and $P^o_{Pd}$=3.57×10 Pa, the harmonic evaporation composition is determined to be 0.0<X<1.0 in the same manner as described above.

So far as an $Au_{1-X}Sn_X$ alloy is concerned, for example, from activity values $a_{Au}$ and $a_{Sn}$ of the respective component elements at 550° C. to the atomic fraction and vapor pressures of respective pure substances at 550° C., $P^o_{Au}=1.36\times10^{-12}$ Pa and $P^o_{Sn}=3.32\times10^{-9}$ Pa, the harmonic evaporation composition is determined to be X=0.11 in the same manner. Also, the tolerable composition range wherein a deviation between the atomic fraction of the raw material and the atomic fraction of the alloy fine particle to be produced falls within ±0.10 is determined to be $0.0<X\leqq0.16$.

So far as a $Co_{1-X}Fe_X$ alloy is concerned, for example, from activity values $a_{Co}$ and $a_{Fe}$ of the respective component elements at 1,600° C. to the atomic fraction and vapor pressures of respective pure substances at 1,600° C., $P^o_{Co}$=4.70 Pa and $P^o_{Fe}$=5.72 Pa, the harmonic evaporation composition is determined to be $0.50\leqq X<1.0$ in the same manner. Also, the tolerable composition range wherein a deviation between the atomic fraction of the raw material and the atomic fraction of the alloy fine particle to be produced falls within ±0.10 is determined to be 0.0<X<1.0.

So far as a $Co_{1-X}Ni_X$ alloy is concerned, for example, from activity values $a_{Co}$ and $a_{Ni}$ of the respective component elements at 1,627° C. to the atomic fraction and vapor pressures of respective pure substances at 1,627° C., $P^o_{Co}$=6.83 Pa and $P^o_{Ni}$=5.44 Pa, the harmonic evaporation composition is determined to be 0.0<X<1.0 in the same manner.

So far as a $Co_{1-X}Pd_X$ alloy is concerned, for example, from activity values $a_{Co}$ and $a_{Pd}$ of the respective component elements at 1,577° C. to the atomic fraction and vapor pressures of respective pure substances at 1,577° C., $P^o_{Co}$=3.39 Pa and $P^o_{Pd}$=1.89 Pa, the harmonic evaporation composition is determined to be 0.0<X<1.0 in the same manner.

So far as a $Cr_{1-X}Ni_X$ alloy is concerned, for example, from activity values $a_{Cr}$ and $a_{Ni}$ of the respective component elements at 1,927° C. to the atomic fraction and vapor pressures of respective pure substances at 1,927° C., $P^o_{Cr}=8.06\times10^2$ Pa and $P^o_{Ni}=1.95\times10^2$ Pa, the harmonic evaporation composition is determined to be $0.96\leqq X<1.0$ in the same manner. Also, the tolerable composition range wherein a deviation between the atomic fraction of the raw material and the atomic fraction of the alloy fine particle to be produced falls within ±0.10 is determined to be $0.75\leqq X\leqq1.0$.

So far as a $Cu_{1-X}Si_X$ alloy is concerned, for example, from activity values $a_{Cu}$ and $a_{Si}$ of the respective component elements at 1,427° C. to the atomic fraction and vapor pressures of respective pure substances at 1,427° C., $P^o_{Cu}$=1.05×10 Pa and $P^o_{Si}$=6.31 Pa, the harmonic evaporation composition is determined to be 0.0<X<0.15 or X=0.40 in the same manner. Also, the tolerable composition range wherein a deviation between the atomic fraction of the raw material and the atomic fraction of the alloy fine particle to be produced falls within ±0.10 is determined to be 0.0<X<0.45.

So far as a $Cu_{1-X}Sn_X$ alloy is concerned, for example, from activity values $a_{Cu}$ and $a_{Sn}$ of the respective component elements at 1,127° C. to the atomic fraction and vapor pressures of respective pure substances at 1,127° C., $P^o_{Cu}=8.00\times10^{-2}$ Pa and $P^o_{Si}=1.92\times10^{-1}$ Pa, the harmonic evaporation composition is determined to be X=0.26 in the same manner. Also, the tolerable composition range wherein a deviation between the atomic fraction of the raw material and the atomic fraction of the alloy fine particle to be produced falls within ±0.10 is determined to be $0.0<X\leqq0.33$.

So far as an $Fe_{1-X}Ni_X$ alloy is concerned, for example, from activity values $a_{Fe}$ and $a_{Ni}$ of the respective component elements at 1,600° C. to the atomic fraction and vapor pressures of respective pure substances at 1,600° C., $P^o_{Fe}=5.76$ Pa and $P^o_{Ni}=3.72$ Pa, the harmonic evaporation composition is determined to be X=0.80 in the same manner. Also, the tolerable composition range wherein a deviation between the atomic fraction of the raw material and the atomic fraction of the alloy fine particle to be produced falls within ±0.10 is determined to be $0.60\leqq X<1.0$.

So far as an $Fe_{1-X}Pd_X$ alloy is concerned, for example, from activity values $a_{Fe}$ and $a_{Pd}$ of the respective component elements at 1,577° C. to the atomic fraction and vapor pressures of respective pure substances at 1,600° C., $P^o_{Fe}=425$ Pa and $P^o_{Pd}=1.89$ Pa, the harmonic evaporation composition is determined to be $0.70\leqq X\leqq0.75$ in the same manner. Also, the tolerable composition range wherein a deviation between the atomic fraction of the raw material and the atomic fraction of the alloy fine particle to be produced falls within ±0.10 is determined to be $0.64\leqq X<1.0$.

So far as an $Fe_{1-X}Si_X$ alloy is concerned, for example, from activity values $a_{Fe}$ and $a_{Si}$ of the respective component elements at 1,600° C. to the atomic fraction and vapor pressures of respective pure substances at 1,600° C., $P^o_{Fe}=6.25$ Pa and $P^o_{Si}=6.03\times10$ Pa, the harmonic evaporation composition is determined to be X=0.35 in the same manner. Also, the tolerable composition range wherein a deviation between the atomic fraction of the raw material and the atomic fraction of the alloy fine particle to be produced falls within ±0.10 is determined to be $0.30\leqq X\leqq0.37$.

So far as an $Ni_{1-X}Pd_X$ alloy is concerned, for example, from activity values $a_{Ni}$ any and $a_{Pd}$ of the respective component elements at 1,600° C. to the atomic fraction and vapor pressures of respective pure substances at 1,600° C., $P^o_{Fe}=3.72$ Pa and $P^o_{Pd}=2.53$ Pa, the harmonic evaporation composition is determined to be $0.0<X\leqq0.25$ in the same manner. Also, the tolerable composition range wherein a deviation between the atomic fraction of the raw material and the atomic fraction of the alloy fine particle to be produced falls within ±0.10 is determined to be $0.0<X<1.0$.

So far as an $Ag_{1-X}Cu_X$ alloy is concerned, for example, from activity values $a_{Ag}$ and $a_{Cu}$ of the respective component elements at 1,150° C. to the atomic fraction and vapor pressures of respective pure substances at 1,150° C., $P^o_{Ag}=1.18\times10$ Pa and $P^o_{Pd}=1.39\times10^{-1}$ Pa, the harmonic evaporation composition is determined to be 0.10 in the same manner. Also, the tolerable composition range wherein a deviation between the atomic fraction of the raw material and the atomic fraction of the alloy fine particle to be produced falls within ±0.10 is determined to be $0.0<X\leqq0.25$.

As one example of the production method of an alloy fine particle colloid, a production method by the active liquid surface continuous vacuum vapor deposition method is hereunder described.

As to the above-selected alloys, the respective metal elements are weighed in a ratio within the calculated suitable alloy composition range, desirably in an optimal alloy composition ratio and heat melted and mixed in vacuo or in an inert gas, thereby producing a homogeneous alloy ingot. As a method of heat melting, known technologies such as an arc melting method, a high-frequency melting method, a resistance heat melting method or the like can be employed. The obtained alloy ingot is subjected to rolling processing or wire drawing processing and then cut into an appropriate size to form a raw material alloy 4. The $Cu_{1-X}Sn_X$ alloy and the $Fe_{1-X}Si_X$ alloy can be easily crushed upon application an impact by a hammer, whereby a suitable small piece of the raw material alloy can be prepared.

A diagrammatic view of a production apparatus of a fine particle by the method of the continuous vacuum vapor deposition onto an active liquid surface as employed in the invention is illustrated in FIG. 1. A rotary vacuum chamber 2 the inside of which is exhausted in a high degree of vacuum is provided around a fixed axis 1 which also serves as a vacuum exhaust pipe; and a liquid medium 3 having a surfactant added thereto is charged in the inside of the cylinder of the rotary vacuum chamber 2. The filling amount of the liquid medium 3 is preferably from 3 to 8% of the total volume of the inside of the cylinder. At the time of synthesis of a fine particle, the degree of vacuum of not larger than $5\times10^{-4}$ Torr is preferable from the standpoints of oxidation inhibition of the fine particle, dispersibility of the fine particle and production efficiency. The "liquid medium" 3 is a liquid which becomes a dispersion medium of the alloy fine particle colloid, and an oily medium is favorably used.

Also, the liquid medium 3 is preferably one having a low vapor pressure and having heat resistance. A vapor pressure of the liquid medium 3 at room temperature is preferably not larger than $5\times10^{-4}$ Torr. When the vapor pressure exceeds $5\times10^{-4}$ Torr, there may be the case where the purity and particle size distribution of the fine particle are adversely affected. Specifically, alkylnaphthalenes, low-vapor pressure hydrocarbons, alkyldiphenyl ethers, polyphenyl ethers, diesters, silicone oils and fluorocarbon oils can be exemplified.

The surfactant plays a role as a dispersant for dispersing the metal fine particle in the liquid medium 3. In order to prevent coagulation of fine particles, the surfactant is preferably a surfactant which is homogeneously dissolved in the liquid medium to be used without forming micelles. The concentration of the surfactant in the liquid medium is preferably from 2 to 10% from the standpoints of dispersibility of the alloy fine particle colloid to be produced and raw material yield. As to the surfactant, any of anionic, cationic or nonionic surfactant can be used in conformity with chemical properties of the surface of the fine particle to be dispersed and the liquid medium. Specifically, examples of anionic surfactants include alkali metal salts or amine salts of a fatty acid, sulfonic acid salts including alkylallylsulfonates and octadecylbenzenesulfonate, and phosphoric acid salts; examples of cationic surfactants include amine derivatives; and examples of nonionic surfactants include pentaerythritol monooleate and sorbitan oleate. An evaporation source 5 is set up in the fixed axis 1, and the raw material alloy 4 is filled therein.

The prepared raw material alloy 4 is charged in the evaporation source 5 and heated in a reduced-pressure environment to evaporate the raw material alloy 4. Any material can be used as the evaporation source 5 so far as it can be heated to a high temperature sufficient for evaporating the raw material alloy 4. For example, a tungsten resistance wire is wound around a heat-resistant crucible having the raw material alloy 4 charged therein as illustrated in FIG. 1, and the heat-resistant crucible is heated by passing an electric current through the tungsten resistance wire, whereby the raw material alloy 4 can be efficiently evaporated. The heating temperature can be regulated depending upon the kind of the raw material alloy 4 and is preferably from 100 to 180% of the highest melting point among melting points at atmospheric pressure of the individual constitutional elements of the raw material alloy 4. An electric power to be supplied to the crucible is preferably within the range of 50 to 600 W. In order to block radiant heat radiated from the evaporation source 5 having been heated at a high temperature from the surrounding liquid medium 3, the surroundings of the evaporation source 5 are blocked by a radiation insulating plate 6.

Also, for the purpose of removing the heat, the whole of the rotary vacuum chamber 2 is cooled by a cooling water flow 7, and the temperature of the liquid medium 3 is kept substantially at room temperature even at the time of synthesis of an alloy fine particle 11. The raw material alloy 4 is heated and evaporated by the heated evaporation source 5, whereby the raw material alloy 4 is vapor deposited in a state that the evaporated metal vapor 10 is adsorbed in a portion opposing to the evaporation source on the inner wall surface of the rotary vacuum chamber. A thermocouple 8 is provided for the purpose of monitoring the temperature of the liquid film of the liquid medium at the time of vapor deposition. In the vapor deposition, the rotary vacuum chamber 2 is rotated at a fixed rate. A peripheral velocity of the rotation is preferably from 10 to 100 mm/s, but an upper limit of the peripheral velocity is not particularly restricted. The liquid medium 3 is formed into a thin liquid film 9 and spread to an upper part of the rotary vacuum chamber 2, and the inner wall surface of the rotary vacuum chamber 2 becomes in a uniformly wetted state with the liquid medium 3. As described previously, the liquid medium 3 contains a surfactant, and in the case where the liquid medium is an oily medium, in the surfactant molecule, one end of the molecule is an lipophilic group, with the other end being a hydrophilic group. Therefore, there is a tendency that the hydrophilic group gathers on the surface of the liquid film 9 of the liquid medium having been spread on the inner wall surface of the rotary vacuum chamber 2 while being faced toward the side of the film surface. As a result, the surface of the liquid film 9 of the liquid medium is modified into a surface which is rich in adsorbability to hydrophilic substances. For that reason, a metal vapor 10 which evaporates from the evaporation source 5 efficiently adsorbs onto the liquid film 9 of the liquid medium, thereby forming the alloy fine particle 11. This is a reason why this method is called a vapor deposition onto an active liquid surface.

Thus, the alloy fine particle 11 formed on the upper inner wall surface of the rotary vacuum chamber 2 is covered by the surfactant on the spot, becomes in an adapted state to the liquid medium and is then put on the rotation of the rotary vacuum chamber 2 and transported into a bottom. At the same time, the liquid film 9 of a new liquid medium is supplied from the bottom to the upper part of the rotary vacuum chamber 2. By continuing the heating and evaporation of the raw material alloy 4 while rotating the rotary vacuum chamber, a prescribed alloy fine particle colloid dispersion 12 homogeneously dispersed in an oil is obtained in the bottom of the rotary vacuum chamber.

In general, the evaporation rate is from about 0.3 to 1.0 g/min. While the first charged raw material alloy is consumed for from several minutes to several tens minutes, it is a characteristic feature of the method of the invention that a low-vapor pressure component does not remain as a residue. If it is intended to produce a concentrated colloid, an alloy raw material ingot is additionally charged in the evaporation source in the equipment, and the foregoing steps are again repeated. In this way, it is possible to produce an alloy fine particle colloid with a homogeneous composition having a prescribed composition.

The thus obtained alloy fine particle colloid has an inherent size depending upon the alloy species. Fe, Co, Cr or Pd based alloys have the smallest size and have a diameter of 2 nm, whereas Ag based alloys have the largest size and have a diameter of from 10 to 17 nm. As to the alloy composition of these alloy fine particles, every fine particle can be measured by an energy dispersion type micro analyzer using a micro beam electron microscope. Furthermore, as to a number of fine particles in the field of view of an electron microscope at random, the respective compositions are analyzed, whereby a scattering of the alloy composition of a fine particle system can be evaluated.

So long as an alloy as the raw material in the invention is used as a raw material alloy, the method is not limited to the active liquid surface continuous vacuum vapor deposition method. Any method is employable so far as it is a method for cooling an alloy vapor to generate an alloy fine particle and taking in and collecting it in an organic solvent. For example, even in the case of a gas evaporation method, the same action and effect can be exhibited.

The alloy fine particle colloid according to the invention is a colloid in which an alloy fine particle of a nanometer size is dispersed in a high concentration in a liquid. In particular, one having high electrical conductivity is useful as a conductive ink and is utilized for manufacture of printed circuit boards by a printing method and formation of electrodes such as stacked condensers and chip type resistors. Also, a noble metal-containing alloy fine particle assumes a color tone of every kind which varies depending upon the alloy composition, and therefore, it is also useful as a pigment ink with a controlled color tone. Among the alloy fine particle colloids, those which strongly absorb light to assume a strong black color are included. Such an alloy fine particle colloid is utilized for not only liquid crystal panel display devices but plasma display or organic electric field light emitting display devices. An alloy fine particle colloid containing an iron group transition metal and exhibiting ferromagnetic properties exhibits properties as a magnetic fluid, and therefore, it is utilized for various instruments wherein a magnetic fluid is applied, namely a vacuum seal of a vacuum rotary bearing, a Hi-Fi speaker for faithfully reproducing sounds, a dustproof seal of a rotary shaft and the like.

Furthermore, alloy fine particle-supported diatomaceous earth, active carbon or alumina or the like which is produced by using the alloy fine particle colloid as a raw material and subjecting it to an appropriate treatment is utilized as various catalysts, namely catalysts for a dehydrogenation reaction such as production of hydrogen ($H_2$) from methane ($CH_4$) or other hydrocarbons by a steam reforming method or a decomposition reaction of ammonia ($NH_3$); catalysts for hydrogenation reaction such as conversion from an unsaturated fatty acid to a saturated fatty acid, production of a hydrogenated oil such as margarine or a soap from an unsaturated liquid edible oil, or conversion from an olefin to a paraffin; catalysts for conversion from a heavy oil into gasoline by cracking or production of synthetic fuels such as production of high-octane gasoline from petroleum naphtha; or catalysts for air pollution prevention against an engine exhaust gas. Also, a Pd-containing alloy fine particle supported in a conductive substance such as active carbon is utilized as anode and cathode active materials of a fuel cell capable of converting chemical energy to electric energy.

Next, specific embodiments of the invention are described with reference to the following Examples. As a matter of course, it should not be construed that the invention is limited thereto.

EXAMPLES

Example 1

Production of Cobalt-Iron Alloy Fine Particle Colloid

In a cobalt-iron alloy ($Co_{1-X}Fe_X$) system, it is impossible to produce an alloy fine particle colloid over an entire composition region in the range of 0.0<X 1.0 by applying the invention. In particular, it is possible to produce an alloy fine particle colloid which preciously reflects the raw material alloy composition within the range of $0.50 \leqq X < 1.0$. As a representative example, a $Co_{0.5}Fe_{0.5}$ alloy fine particle colloid is described.

First of all, Co and Fe metal elements were weighed in a stoichiometric ratio, respectively and homogeneously melted and mixed by a high-frequency melting method, and the mixture was then cast into a mold to prepare a cast ingot. The thus obtained cast ingot was measured for composition by a chemical analysis, and as a result, the charging composition was precisely reproduced. The cast ingot of the $Co_{0.5}Fe_{0.5}$ alloy was cut to prepare alloy small pieces of from several grams to 20 grams. About 30 g of this $Co_{0.5}Fe_{0.5}$ alloy small-piece was filled in the evaporation source crucible as illustrate in FIG. 1 by the method of the continuous vacuum vapor deposition onto the active liquid surface. On the other hand, 260 g (300 cc) of a 10% polybutenyl succinic acid pentamine-imide-alkylnaphthalene solution was poured in the bottom of the rotary vacuum chamber. When the evaporation source was heated while rotating the rotary vacuum chamber at a peripheral velocity of 34 mm/s, and the temperature was further raised exceeding the melting point of the alloy, evaporation of the alloy was initiated, and an alloy fine particle was generated on the inner wall surface in an upper part of the rotary vacuum chamber. The behavior could be observed by looking through the heat-resistant glass-made rotary vacuum chamber. An electric power to be supplied to the evaporation source was 370 W. The raw material was completely consumed for the evaporation time of about 50 minutes, and any metal component which is hardly evaporated did not remain in the inside of the crucible. A glass plug located on the side surface of the rotary vacuum chamber was opened while introducing an inert gas into the inside of the rotary vacuum chamber, 30 g of the $Co_{0.5}Fe_{0.5}$ alloy piece was further filled, and the same process was repeated.

There was thus produced a stable cobalt-iron alloy fine particle colloid in a high concentration. An average evaporation rate of the raw material was 0.6 g/min. Also, a specific gravity of the obtained colloid was 1.07, and a concentration of the colloid dispersion phase was estimated to be 16.5% from this specific gravity. A yield was calculated to be 92% from these values. The obtained cobalt-iron alloy colloid dispersion exhibited a low viscosity and exhibited smooth fluidity. The dispersion assumed a strong black color, was strongly reactive with a magnetic field and exhibited properties as a magnetic fluid.

Figure 5:
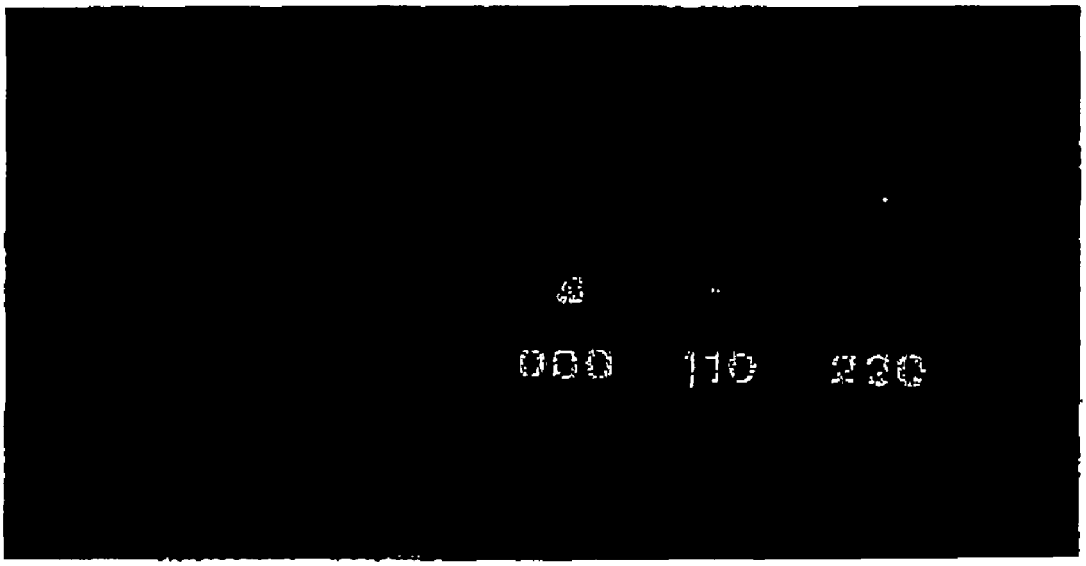
FIG. 5 is an electron diffraction pattern of a single $Co_{0.5}Fe_{0.5}$ fine particle obtained in Example 1.
Figure 6:
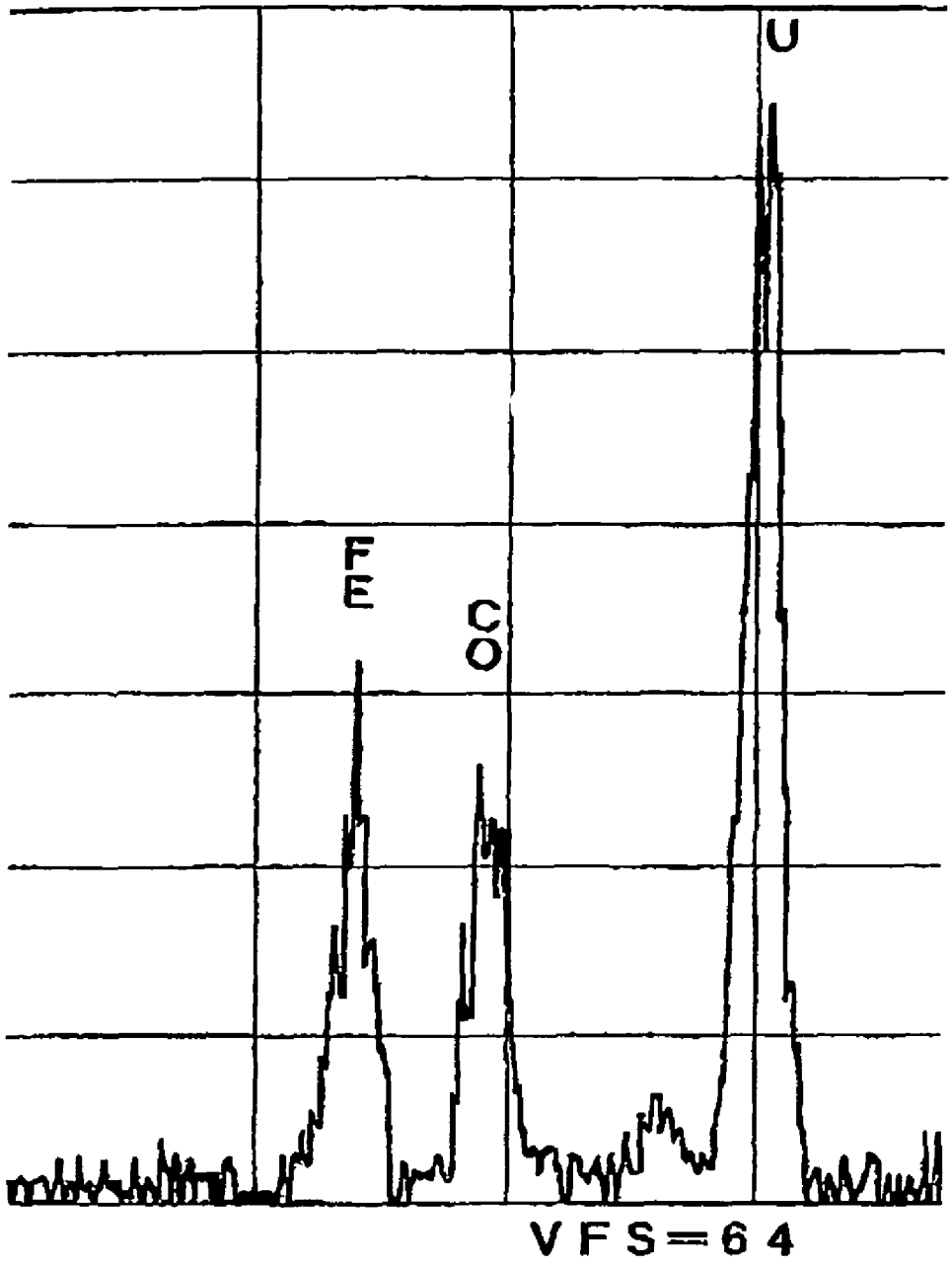
FIG. 6 is an energy dispersion type X-ray (EDX) spectrum of a single $Co_{0.5}Fe_{0.5}$ fine particle obtained in Example 1.

The individual alloy fine particles were analyzed for crystal structure and composition using a micro beam electron microscope and an energy dispersion type X-ray analyzer (EDX) attached thereto. An electron diffraction pattern and a characteristic X-ray spectrum of the single fine particle are respectively shown in FIGS. 5 and 6. It is understood from FIG. 5 that the fine particle is a single crystal and that its structure is a bcc structure. The same was applied to all of the measured fine particles. Also, in FIG. 6, the first spectral line from the left shows a characteristic X-ray of Fe; and the second spectral line shows a characteristic X-ray of Co. It is noted from an integral intensity ratio thereof that the composition of the fine particle is 50 at. % Co—Fe. The third spectral line is a characteristic X-ray of copper generated from a copper mesh for holding the fine particle but not one generated from the fine particle. A number of particles were subjected to the composition analysis in this way. As a result, a scattering in composition of every particle was not found within the measurable range of precision. An average particle size of the colloid was about 2 nm.

Example 2

Production of Fe—Pd Alloy Fine Particle Colloid

By applying the invention, a substantially homogeneous $Fe_{1-X}Pd_X$ based alloy fine particle colloid which reflects the raw material alloy composition within the range of $0.64 \leqq X < 1.0$ in the $Fe_{1-X}Pd_X$ based alloy can be produced. More desirably, by restricting the range of $0.70 \leqq X \leqq 0.75$, a homogeneous $Fe_{1-X}Pd_X$ based alloy fine particle colloid which preciously coincides with the raw material alloy composition can be produced. As a typical example thereof, an $Fe_{0.25}Pd_{0.75}$ alloy fine particle colloid is described. This alloy constitutes an intermetallic compound of $FePd_3$.

An $Fe_{0.25}Pd_{0.75}$ alloy ingot was prepared in the same manner as in the case of the preceding Example 1. It is possible to subject this alloy to cold rolling. This alloy was rolled in an appropriate thickness using a rolling machine and then cut to prepare alloy small pieces of from several grams to 20 grams. This $Fe_{0.25}Pd_{0.75}$ alloy piece was filled in the evaporation source crucible as illustrate in FIG. 1, and the process for producing an alloy fine particle colloid was carried out in the same manner as in the case of $Co_{0.5}Fe_{0.5}$ of Example 1. The individual fine particles were analyzed for crystal structure and composition using a micro beam electron microscope and EDX. As a result, all of the measured fine particles had a face centered tetragonal (fct) structure and a composition of 25 at. % Fe—Pd and were confirmed to have an intermetallic compound $FePd_3$ phase. An average particle size of the colloid was about 2 nm.

Example 3

Production of Ag—In Alloy Fine Particle Colloid

By applying the invention, a substantially homogeneous $Ag_{1-X}In_X$ based alloy fine particle colloid which reflects the raw material alloy composition within the range of $0.0 < X \leqq 0.20$ in the $Ag_{1-X}In_X$ based alloy can be produced. Desirably, by restricting X at 0.14 and using an $Ag_{0.86}In_{0.14}$ alloy as a raw material, a homogeneous $Ag_{0.86}In_{0.14}$ based alloy fine particle colloid which preciously coincides with the raw material alloy composition can be produced. In this Example, an $Ag_{0.86}In_{0.14}$ alloy fine particle colloid is described in detail.

The preparation of a raw material ingot of the $Ag_{0.86}In_{0.14}$ alloy and the preparation of an alloy fine particle colloid by the active liquid surface continuous vacuum vapor deposition method were carried out in the same manner as in the preceding Example 1, except for using 260 g (300 cc) of a 7% sorbitan trioleate-alkylnaphthalene solution as a dispersion medium, setting up a peripheral velocity of the rotary vacuum chamber at 100 mm/s and setting up an electric power to be supplied to the evaporation source for steadily evaporating the raw material alloy at 105 W. Sorbitantrioleate was used as one which is considered to be appropriate for obtaining a stable and safe Ag colloid. During the process of continuing the evaporation while properly supplementing the raw material alloy, metal components which are hardly evaporated did not remain in the inside of the crucible.

The individual alloy fine particles were analyzed for crystal structure and composition using a micro beam electron microscope and an energy dispersion type X-ray analyzer (EDX) attached thereto. As a result, all of the measured fine particles had an fcc structure, and a composition thereof was 14 at. % In—Ag and coincided with the composition of the raw material alloy. Simultaneously, a scattering in composition of every particle was not found within the measurable range of precision. An average particle size of the colloid was 15 nm.

In the light of the above, it was confirmed that by applying the invention, an alloy fine particle colloid having a composition equal to the raw material composition is obtainable.

The invention claimed is:

1. A method for producing an alloy fine particle colloid by heating and evaporating a raw material binary alloy which is in a solid state in an ambient temperature and pressure environment under a vacuum of not more than $5\times10^{-4}$ Torr and bringing a generated vapor into contact with a liquid medium charged in the inside of a rotary vacuum chamber, and cooling the generated vapor for condensation and solidification to form an alloy fine particle colloid, wherein (1) when an atomic fraction of a component element in the raw material alloy is defined as X, a component ratio of each of the elements of the raw material alloy is regulated such that a fraction of a vapor pressure of the component element to the total vapor pressure of the raw material alloy falls within the range of from (X−0.1) to (X+0.1);

(2) the raw material binary alloy is an alloy species which forms a homogeneous alloy phase in an alloy ingot;

(3) the liquid medium has low vapor pressure not larger than $5\times10^{-4}$ Torr at room temperature; and (4) the liquid medium is cooled by cooling water flow outside of a cylinder, and the liquid medium is kept substantially at room temperature at the time of synthesis of the alloy fine particle.

2. The method for producing an alloy fine particle colloid according to claim 1, wherein the alloy fine particle colloid is an alloy fine particle colloid of Ag and In, and a composition of the raw material alloy is $Ag_{1-x}In_x$ ($0.0<x\leqq0.20$).

3. The method for producing an alloy fine particle colloid according to claim 1, wherein the alloy fine particle colloid is an alloy fine particle colloid of Au and Pd, and a composition of the raw material alloy is $Au_{1-x}Pd_x$ ($0.0<x\leqq1.0$).

4. The method for producing an alloy fine particle colloid according to claim 1, wherein the alloy fine particle colloid is an alloy fine particle colloid of Au and Sn, and a composition of the raw material alloy is $Au_{1-x}Sn_x$ ($0.0<x\leqq0.16$).

5. The method for producing an alloy fine particle colloid according to claim 1, wherein the alloy fine particle colloid is an alloy fine particle colloid of Co and Ni, and a composition of the raw material alloy is $Co_{1-x}Ni_x$ ($0.0<x<1.0$).

6. The method for producing an alloy fine particle colloid according to claim 1, wherein the alloy fine particle colloid is an alloy fine particle colloid of Co and Pd, and a composition of the raw material alloy is $Co_{1-x}Pd_x$ ($0.0<x<1.0$).

7. The method for producing an alloy fine particle colloid according to claim 1, wherein the alloy fine particle colloid is an alloy fine particle colloid of Cr and Ni, and a composition of the raw material alloy is $Cr_{1-x}Ni_x$ ($0.75\leqq x<1.0$).

8. The method for producing an alloy fine particle colloid according to claim 1, wherein the alloy fine particle colloid is an alloy fine particle colloid of Cu and Si, and a composition of the raw material alloy is $Cu_{1-x}Si_x$ ($0.0<x\leqq0.45$).

9. The method for producing an alloy fine particle colloid according to claim 1, wherein the alloy fine particle colloid is an alloy fine particle colloid of Cu and Sn, and a composition of the raw material alloy is $Cu_{1-x}Sn_x$ ($0.0<x\leqq0.33$).

10. The method for producing an alloy fine particle colloid according to claim 1, wherein the alloy fine particle colloid is an alloy fine particle colloid of Fe and Ni, and a composition of the raw material alloy is $Fe_{1-x}Ni_x$ ($0.60\leqq x<1.0$).

11. The method for producing an alloy fine particle colloid according to claim 1, wherein the alloy fine particle colloid is an alloy fine particle colloid of Fe and Pd, and a composition of the raw material alloy is $Fe_{1-x}Pd_x$ ($0.64\leqq x<1.0$).

12. The method for producing an alloy fine particle colloid according to claim 1, wherein the alloy fine particle colloid is an alloy fine particle colloid of Fe and Si, and a composition of the raw material alloy is $Fe_{1-x}Si_x$ ($0.30\leqq x\leqq0.37$).

13. The method for producing an alloy fine particle colloid according to claim 1, wherein the alloy fine particle colloid is an alloy fine particle colloid of Ni and Pd, and a composition of the raw material alloy is $Ni_{1-x}Pd_x$ ($0.0<x<1.0$).

14. The method for producing an alloy fine particle colloid according to claim 1, wherein the alloy fine particle colloid is an alloy fine particle colloid of Ag and Cu, and a composition of the raw material alloy is $Ag_{1-x}Cu_x$ ($0.0<x\leqq0.25$).

* * * * *